United States Patent [19]

Conry

[11] 4,317,307

[45] Mar. 2, 1982

[54] WALK BEHIND, STEERABLE WHEELED TOY

[76] Inventor: Raymond F. Conry, 4701 Aberdeen Rd., Mound, Minn. 55364

[21] Appl. No.: 182,964

[22] Filed: Sep. 2, 1980

[51] Int. Cl.[3] ..... A63H 30/00

[52] U.S. Cl. ..... 46/210; 280/47.34

[58] Field of Search ..... 46/1 B, 205, 261, 210, 46/220, 114, 202; 180/19 S; 280/267, 47.17, 47.34

[56] References Cited

U.S. PATENT DOCUMENTS

| | | | |
|---|---|---|---|
| 2,647,343 | 8/1953 | Zileri et al. | 46/201 X |
| 2,730,837 | 1/1956 | Vaughan | 46/210 |
| 2,887,823 | 5/1959 | Vaughan | 46/210 X |
| 3,401,951 | 9/1968 | Bloom | 280/47.17 |
| 3,612,555 | 10/1971 | Baker | 280/47.17 X |

FOREIGN PATENT DOCUMENTS

| | | | |
|---|---|---|---|
| 917419 | 7/1954 | Fed. Rep. of Germany | 46/210 |
| 1009953 | 6/1952 | France | 46/210 |

*Primary Examiner*—Robert Peshock

*Assistant Examiner*—Mickey Yu

*Attorney, Agent, or Firm*—Peterson, Palmatier, Sturm & Sjoquist

[57] ABSTRACT

The toy includes a chassis having a pair of laterally spaced wheels and a forwardly disposed castor wheel. A bearing block is journaled in the upstanding sides of the chassis for rocking or pivotal movement about a transverse axis. A tubular steering column has a lower straight portion pivotally disposed in a bore formed in the bearing block which bore extends in a fore and aft direction, the straight portion of the steering column having an upwardly facing arcuate slot. Retaining the straight portion in the bore of the bearing block, yet permitting pivotal movement of the steering column about the axis of the bore, is a screw projecting downwardly from the upper surface of the bearing block into the slot. The steering column has an upwardly curving portion integral with the straight portion and also a second straight portion inclining upwardly from the curved portion, the steering wheel being affixed to the upper end of the inclined portion.

3 Claims, 4 Drawing Figures

Fig. 3
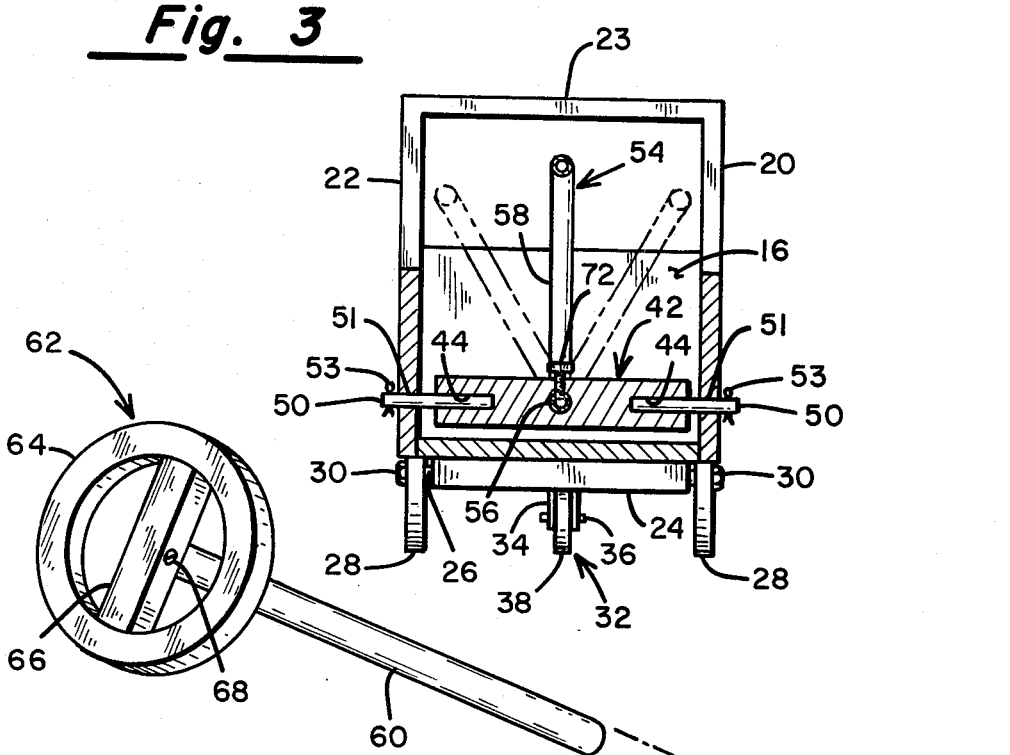
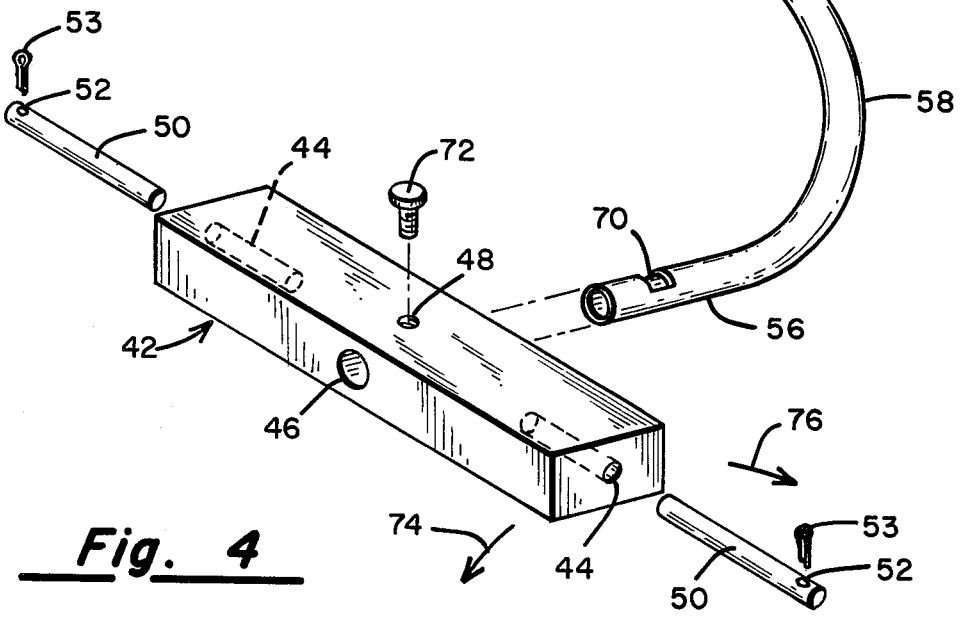
Fig. 4

WALK BEHIND, STEERABLE WHEELED TOY

BACKGROUND OF THE INVENTION

1. Field of the Invention

This invention relates generally to wheeled toys, and pertains more particularly to a wheeled toy having a specially mounted steering column so that the child can push and steer the toy as he walks behind it.

2. Description of the Prior Art

Having some similarity to my invention is the toy depicted in U.S. Pat. No. 2,730,837, issued on Jan. 17, 1956 to Charles H. Vaughn and titled "Control Mechanism for Toy". The patented construction differs, however, from the present invention in several respects. Mainly, the patented construction makes use of a flexible coupling which is incorporated in the steering mechanism so that the toy remains on the surface over which it is being pushed. Also, the toy lacks realism in that the front of the toy vehicle is slidably swung in either direction when the toy is being steered. Still further, the steering wheel is located considerably rearwardly with respect to the toy, not being situated where the child would normally expect the steering wheel to be.

SUMMARY OF THE INVENTION

Accordingly, one object of my invention is to provide a toy that can be steered by the child as the child walks behind it, the steering being quite realistic.

Another object of the invention is to provide easy steering for the toy in that there is no sliding or scraping movement of any wheels with respect to the surface over which the toy is being pushed.

Another object is to provide a wheeled toy that will always remain level, there being no flexible or resilient joints required in the achieving of this particular goal.

Yet another object of the invention is to provide a toy that will be exceedingly rugged and which will withstand rough usage by children of various ages.

Still further, an object of the invention is to provide a toy that will be intriguing by reason of the particular movements derivable by merely twisting the steering wheel.

Another object is to mount the steering column so that the steering wheel can be raised and lowered to suit the height of the child, the child only having to grasp the steering wheel to do this.

Also, my invention has for an object the providing of a toy resembling a vehicle that can be inexpensively manufactured, thereby encouraging its widespread use.

It is also an object of my invention to provide a toy that can be constructed in the form of a wheeled cart so that the child can transport other toys and objects in the cart. In this regard, an aim of the invention is to permit the steering to be performed without objectionable interference from items that the youngster has placed in the cart or chassis.

Briefly, my invention makes use of a bearing block in which a horizontal portion of the tubular steering column is rotatably or pivotally mounted. The bearing block is itself rotatable about a transverse horizontal axis, there being oppositely issuing stub shafts that are journaled in the sides of the chassis. In addition to two laterally spaced wheels, there is a castor wheel so that the toy remains horizontal at all times while it is being steered, the bearing block pivoting about its transverse axis as the steering wheel is turned during the steering of the toy.

BRIEF DESCRIPTION OF THE DRAWINGS

FIG. 3 is a sectional view taken in the direction of line 3—3 of FIG. 2, and FIG. 4 is an exploded perspective view of the steering mechanism which includes the steering column and the bearing block in which the lower horizontal portion of the steering column is mounted for pivotal movement.

DESCRIPTION OF THE PREFERRED EMBODIMENT

Figure 1:
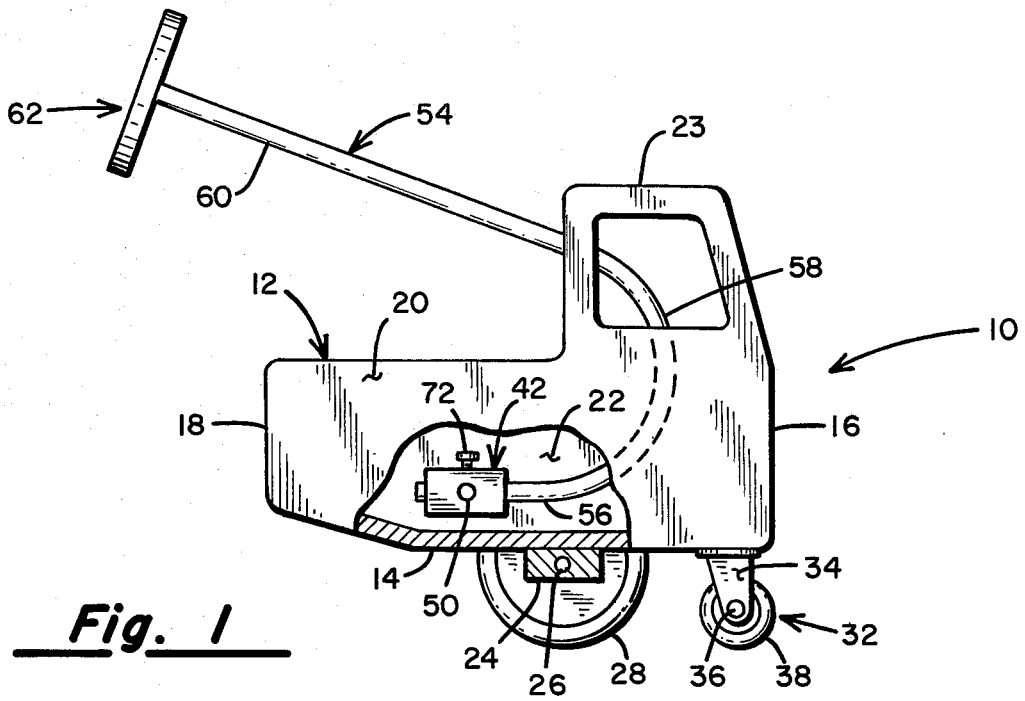
FIG. 1 is a side elevational view of a toy exemplifying my invention, a portion of one side wall having been broken away in order to expose to view a bearing block that is pivotally mounted between the two side walls.

A toy constructed in accordance with the teachings of my invention has been denoted generally by the reference numeral 10. The toy 10 includes in the exemplary instance a frame or chassis 12 comprised of a generally horizontal bottom or base 14, a front wall 16, a rear wall 18, side walls 20, 22, and a roof at 23 (to make the chassis look as though it has a cab section).

Fixedly secured to the underside of the base 14 is a first transverse bearing block 24 having an axle or shaft 26 extending therethrough. A pair of laterally spaced wheels 28 are mounted for rotation on the projecting ends of the axle 26, the wheels 28 being retained on the axle 26 by retention nuts 30.

In addition to the wheels 28, a castor indicated by the reference numeral 32 is mounted adjacent the forward end of the toy, being near the front wall 16. An inverted clevis 34 has an upstanding pin portion (not visible) that is mounted in the base 14 for rotative movement about a vertical axis. The clevis 34 carries at its lower end a shaft 36 on which is rotatably disposed a castor wheel 38. All that need be appreciated is that the castor wheel 38 is free to rotate through a complete circle by virtue of the inverted clevis 34 and the pin that extends upwardly therefrom. The castor 32 is of conventional construction.

Playing an important role in the practicing of my invention is a second transverse bearing block 42 provided with a pair of partially drilled holes or passages 44. While these passages 44 could extend completely through the bearing block 42, the bearing block can be made considerably thinner by having the holes or passages 44 extend only partially through the block 42. The reason for terminating the drilled holes or passages 44 within the confines of the block 42 stems from the fact that an additional drilled hole, more specifically a bore 46, is formed in the bearing block 42, the bore 46 extending in a fore and aft direction. Thus, whereas the holes or passages 44 extend along a transverse axis, the bore 46 extends along a longitudinal axis. The bearing block 42 is formed with a tapped hole 48 that extends downwardly through the top of the bearing block 42 into the bore 46.

At this time, attention is called to a pair of stub shafts or axles 50 that are press fitted into the passages 44. By means of holes 51 in the side walls 20, 22 of the chassis 12, the bearing block 42 is mounted for oscillatory or pivotal movement about a horizontal or transverse axis. The reason for providing such pivotal movement will soon be made manifest. To maintain the block 42 centrally located, the stub shafts 50 have small holes 52 in the projecting ends thereof; a cotter pin 53 is inserted in each of the holes 52 to keep the block 42 from shifting an undue amount.

My toy 10 makes use of a steering column indicated generally by the reference numeral 54. More specifically the steering column 54, which is of tubular metal, includes a relatively short and straight horizontal portion 56, a curved portion 58 integral with the portion 56 and curving upwardly and rearwardly with respect to the portion 56, as well as a fairly long, straight inclined portion 60. At the upper end of the inclined portion 60 of the steering column 54 is a steering wheel 62 having a rim 64 and a diametrically extending spoke 66, the ends of the spoke 66 being fixedly attached to the interior of the rim 64. The spoke 66 is of sufficient width so that a recess (not visible) can be formed therein for the accommodation or reception of the upper end of the inclined portion 60, the steering wheel 62 being secured to the inclined portion 60 through the agency of a set screw 68.

It is to be noted that the horizontal tubular portion 56 of the steering column 54 is formed with an arcuate slot 70. It has already been mentioned that a tapped hole 48 is provided in the bearing block 42. A screw 72 is threadedly received in the tapped hole 48, the lower end of the screw 72 extending into the slot 70. The screw 72 performs a dual function in that it retains the horizontal portion 56 within the bore 46 and also limits the angle through which the steering column 54 can be pivoted.

For the sake of completeness, a pair of oppositely headed arrows 74 and 76 have been applied to FIG. 4, these arrows 74, 76 denoting the rocking or pivotal movement of the block 42 about the horizontal or transverse axis provided by the shafts 50 when the shafts 50 are journaled in the holes 51 (best understood from FIG. 3).

Having presented the foregoing description, the manner in which my toy 10 is pushed and steered should be apparent. The child grasps the steering wheel 62, using the wheel 62 to push the toy 10 forwardly, although the child can also pull on the steering wheel 62 to move the toy 10 rearwardly. It will be understood that the extension of the lower end of the screw 72 into the slot 70 prevents relative longitudinal movement in a fore and aft direction of the tubular portion 60 and hence the entire steering column 54.

Figure 2:
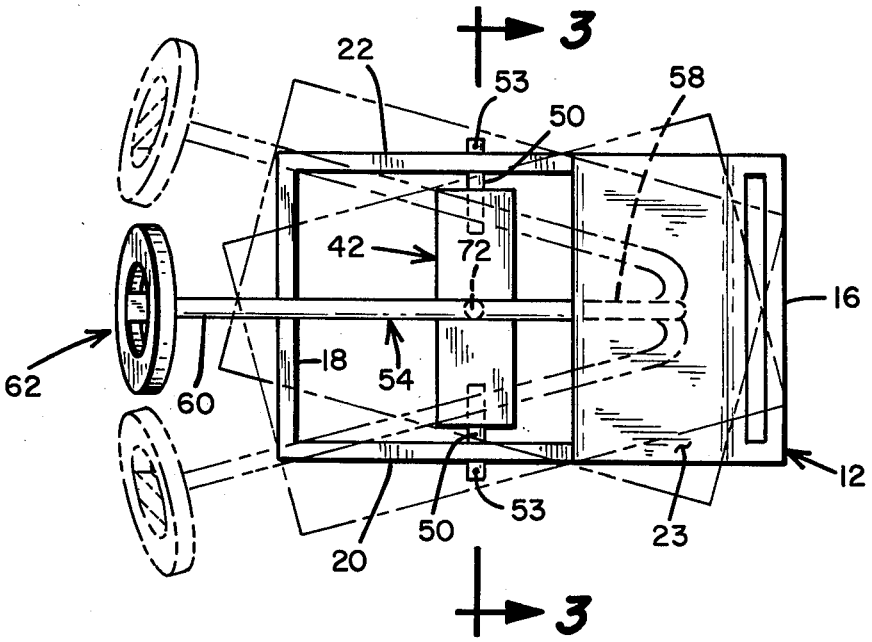
FIG. 2 is a top plan view of my toy, the phantom line positions of the steering column and the corresponding phantom line positions of the chasis illustrating how the toy is steered.

If the child wishes to steer the toy 10 to the right, then he or she simply twists the steering wheel 62 in a clockwise direction with causes the steering wheel 62 and the entire column 54 to assume the phanton position toward the bottom of the sheet as far as FIG. 2 is concerned. If the toy 10 is to be turned to the left, then the child merely twists the steering wheel 62 in a counterclockwise direction. The result appears in the upper phantom line position of the steering wheel 62 and the column 54 as far as FIG. 2 is concerned.

It must be remembered that the steering wheel 62 is fixedly attached to the upper end of the steering column 54, more specifically to the inclined portion 60 by means of the set screw 68. Consequently, whenever the steering wheel 62 is twisted in either rotative direction, the short, straight portion 56 of the steering column 54 pivots within the bore 46, the degree of angulation being limited by the lower end of the screw 72 which projects into the arcuate slot 70. Stated somewhat differently, a form of compound motion is produced via the steering column 54 when the steering wheel 56 is turned. This results in a rocking movement of the transverse bearing block 42 about the transverse axis provided by the oppositely issuing stub shafts 50. The permits the entire chassis 12 to remain horizontal, for the base 14 thereof is supported on the surface (floor, sidewalk or ground) over which the toy 10 is being pushed by reason of the laterally spaced wheel 28 and the castor wheel 38. It will also be recognized that by having the transverse bearing block 52 rockable about a horizontal axis enables the steering wheel 62 to be raised and lowered, the bearing block 42 simply pivoting about its horizontal axis, so that the steering wheel 62 can be moved into a position most suitable for the height of the child. This feature is believed evident from FIG. 1.

I claim:

1. A walk behind toy comprising;

a base having a fore and aft axis;

a pair of spaced wheels disposed on said base, laterally of said fore and aft axis for rotation about a horizontal axis substantially perpendicular to said fore and aft axis;

a transverse bearing block supported above said base, for pivotal or rocking movement about a transverse axis, said bearing block including a bore extending in a fore and aft direction;

a torsionally rigid steering column having a first generally horizontal tubular portion pivotably disposed in the bore in said bearing block, and a second portion inclined upwardly at an angle relative to said first portion;

means drivably coupling the first portion of said steering column to the bore in said bearing block; and a steering wheel affixed to the upper end of the second portion of said steering column whereby the base is free to rotate about the horizontal axis of rotation of said wheels while rotating about a vertical axis of said base.

2. A toy in accordance with claim 1 including laterally spaced side walls extending upwardly from said base, and shaft means issuing in opposite directions from said bearing block and journaled in said side walls.

3. A toy in accordance with claim 2 including a forwardly disposed castor mounted to said base for swivel movement about a vertical axis.

* * * * *